US011295890B2

(12) United States Patent
Lee et al.

(10) Patent No.: US 11,295,890 B2
(45) Date of Patent: Apr. 5, 2022

(54) COIL COMPONENT

(71) Applicant: SAMSUNG ELECTRO-MECHANICS CO., LTD., Suwon-si (KR)

(72) Inventors: Dong Jin Lee, Suwon-si (KR); Dong Hwan Lee, Suwon-si (KR); Young Ghyu Ahn, Suwon-si (KR); Chan Yoon, Suwon-si (KR); Won Chul Sim, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 456 days.

(21) Appl. No.: 16/533,058

(22) Filed: Aug. 6, 2019

(65) Prior Publication Data

US 2020/0286677 A1 Sep. 10, 2020

(30) Foreign Application Priority Data

Mar. 6, 2019 (KR) ..... 10-2019-0025970

(51) Int. Cl.
*H01F 27/29* (2006.01)
*H01F 27/32* (2006.01)

(52) U.S. Cl.
CPC ..... *H01F 27/29* (2013.01); *H01F 27/323* (2013.01)

(58) Field of Classification Search
CPC ..... H01F 27/29; H01F 27/323; H01F 27/292; H01F 17/0013; H01F 27/28; H01F 27/022; H01F 27/245; H01F 27/2847; H01F 27/2852; H01F 27/32; H01F 27/324; H01F 27/2804; H01F 17/0006; H01F 2017/002; H01F 2017/0073; H01F 2027/297
See application file for complete search history.

(56) References Cited

U.S. PATENT DOCUMENTS 6,384,705 B1 * 5/2002 Huang ..... H01F 17/0013 336/200
6,710,694 B2 * 3/2004 Matsuta ..... H01F 17/0013 336/200
7,786,839 B2 * 8/2010 Soendker ..... H01G 4/33 336/200

(Continued)

FOREIGN PATENT DOCUMENTS

JP 2005-159222 A 6/2005
KR 10-1872593 B1 6/2018

*Primary Examiner* — Sizo B Vilakazi
(74) *Attorney, Agent, or Firm* — Morgan, Lewis & Bockius LLP

(57) ABSTRACT

A coil component includes a body; a first substrate disposed inside of the body, and a second substrate, disposed below the first substrate; a first coil layer disposed on an upper surface of the first substrate; a second coil layer disposed between the first substrate and the second substrate; a third coil layer disposed on a lower surface of the second substrate; a conductive via passing through the first substrate and connecting the first coil layer and the second coil layer to each other; a connection electrode disposed outside of the body and connecting the second coil layer and the third coil layer to each other; a first external electrode disposed outside of the body and connected to the first coil layer; and a second external electrode disposed outside of the body and connected to the third coil layer.

17 Claims, 3 Drawing Sheets

(56) References Cited

U.S. PATENT DOCUMENTS

| | | | | |
|---|---|---|---|---|
| 9,312,587 | B2 * | 4/2016 | Lee | H03H 7/427 |
| 10,020,112 | B2 * | 7/2018 | Yoon | H01F 27/255 |
| 10,560,066 | B2 * | 2/2020 | Ishida | H03H 7/0115 |
| 10,614,943 | B2 * | 4/2020 | Choi | H01F 27/255 |
| 11,056,272 | B2 * | 7/2021 | Song | H01F 27/292 |
| 2005/0116793 | A1 * | 6/2005 | Shoji | H03H 7/427 333/185 |
| 2012/0170154 | A1 * | 7/2012 | Sasaki | G11B 5/4853 360/245.3 |

* cited by examiner

COIL COMPONENT

CROSS-REFERENCE TO RELATED APPLICATION

This application claims benefit of priority to Korean Patent Application No. 10-2019-0025970 filed on Mar. 6, 2019 in the Korean Intellectual Property Office, the disclosure of which is incorporated herein by reference in its entirety.

TECHNICAL FIELD

The present disclosure relates to a coil component.

BACKGROUND

In recent years, the miniaturization and thinning of information technology (IT) devices such as various communications devices, display devices, or the like, have accelerated. Research into miniaturization and thinning of various devices such as an inductor, a capacitor, a transistor, and the like, employed in such IT devices have been continuously carried out. Therefore, the inductors have been rapidly switched to a chip capable of miniaturization and high-density automatic surface mounting simultaneously. Further, a thin film type inductor, manufactured by plating upper and lower surfaces of a substrate to form a coil pattern, mixing magnetic powder particles and resins in upper and lower portions of the coil pattern to form a magnetic sheet, and stacking, pressing, and curing the magnetic sheet, is being developed.

However, as the chip size of the thin film type inductor also becomes smaller, the volume of the main body may be reduced. Therefore, the space for forming the coil in the main body may be also reduced, and the turn number of the formed coil may be decreased.

If the area for forming the coil is reduced in this manner, it may become difficult to secure high capacity, and the width of the coil becomes small, to increase the direct current (DC) and alternating current (AC) resistances and to decrease a quality factor (Q).

Therefore, even if the chip size is reduced, it may be necessary to form the coil to occupy the largest possible area in the miniaturized main body, in order to realize an improvement in the high capacity and the quality factor. In addition, there is a need to improve the inductor performance such as the inductance (L) and the quality factor (Q) by increasing an area of the internal coil and promoting flow of the magnetic flux.

SUMMARY

An aspect of the present disclosure is to provide a coil component capable of realizing high capacity by increasing an area in which the coil layer is formed to have the same chip size, even when the chip size is miniaturized.

Another aspect of the present disclosure is to provide a more miniaturized coil component by reducing a space occupied by a conductive via significantly, to maximize the turn number of coils, and utilizing cover space of a magnetic body.

According to an aspect of the present disclosure, a coil component includes a body; a first substrate disposed inside of the body, and a second substrate, disposed below the first substrate; a first coil layer disposed on an upper surface of the first substrate; a second coil layer disposed between the first substrate and the second substrate; a third coil layer disposed on a lower surface of the second substrate; a conductive via passing through the first substrate and connecting the first coil layer and the second coil layer to each other; a connection electrode disposed outside of the body and connecting the second coil layer and the third coil layer to each other; a first external electrode disposed outside of the body and connected to the first coil layer; and a second external electrode disposed outside of the body and connected to the third coil layer.

According to an aspect of the present disclosure, a coil component includes a body; first to third coil layers disposed inside the body, the first coil layer having a first lead-out portion exposed from a first surface of the body, and the second and third coil layers having second and third lead-out portions respectively exposed from a second surface of the body opposing the first surface; a conductive via disposed inside the body and connecting the first coil layer and the second coil layer to each other; a connection electrode disposed on the second surface of the body and connecting the second and third lead-out portions to each other; a first external electrode extending from the first surface onto a third surface of the body which connects the first and second surfaces to each other, the first external electrode connected to the first lead-out portion; a second external electrode disposed on the third surface; and a post penetrating in the body and connecting the third coil layer and the second external electrode to each other.

BRIEF DESCRIPTION OF DRAWINGS

The above and other aspects, features, and advantages of the present disclosure will be more clearly understood from the following detailed description, taken in conjunction with the accompanying drawings, in which.

DETAILED DESCRIPTION

Figure 1:
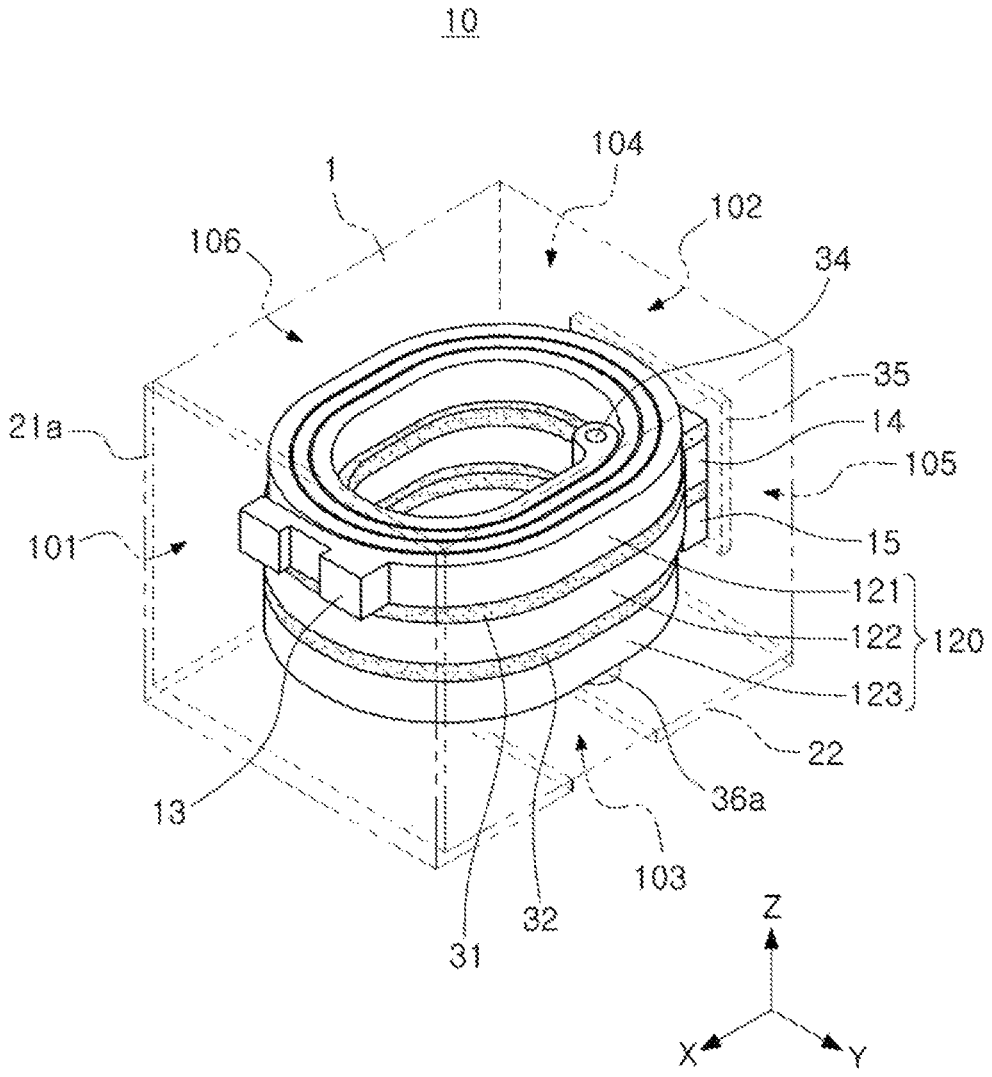
FIG. 1 is a perspective view schematically illustrating a coil component according to an embodiment of the present disclosure.

The terms used in the description of the present disclosure are used to describe a specific embodiment, and are not intended to limit the present disclosure. A singular term includes a plural form unless otherwise indicated. The terms "include," "comprise," "is configured to," etc. of the description of the present disclosure are used to indicate the presence of features, numbers, steps, operations, elements, parts, or combination thereof, and do not exclude the possibilities of combination or addition of one or more additional features, numbers, steps, operations, elements, parts, or combination thereof. Also, the terms "disposed on," "positioned on," and the like, may indicate that an element is positioned on or beneath an object, and does not necessarily mean that the element is positioned above the object with reference to a gravity direction.

The term. "coupled to," "combined to," and the like, may not only indicate that elements are directly and physically in contact with each other, but also include the configuration in which another element is interposed between the elements such that the elements are also in contact with the other component.

Sizes and thicknesses of elements illustrated in the drawings are indicated as examples for ease of description, and the present disclosure are not limited thereto.

In the drawings, an X direction is a first direction or a length direction, a Y direction is a second direction or a width direction, a Z direction is a third direction or a thickness direction.

Hereinafter, a coil component according to an embodiment of the present disclosure will be described in detail with reference to the accompanying drawings. Referring to the accompanying drawings, the same or corresponding components may be denoted by the same reference numerals, and overlapped descriptions will be omitted.

In electronic devices, various types of electronic components may be used, and various types of coil components may be used between the electronic components to remove noise, or for other purposes.

In other words, in electronic devices, a coil component may be used as a power inductor, a high frequency (HF) inductor, a general bead, a high frequency (GHz) bead, a common mode filter, and the like.

In the following description, a coil component 10 according to an embodiment of the present disclosure will be described as a thin film type inductor used for a power supply line of a power supply circuit. However, the coil component according to an embodiment of the present disclosure may be suitably applied to a chip bead, a chip filter, or the like, in addition to the thin film type inductor.

Coil Component

Figure 2:
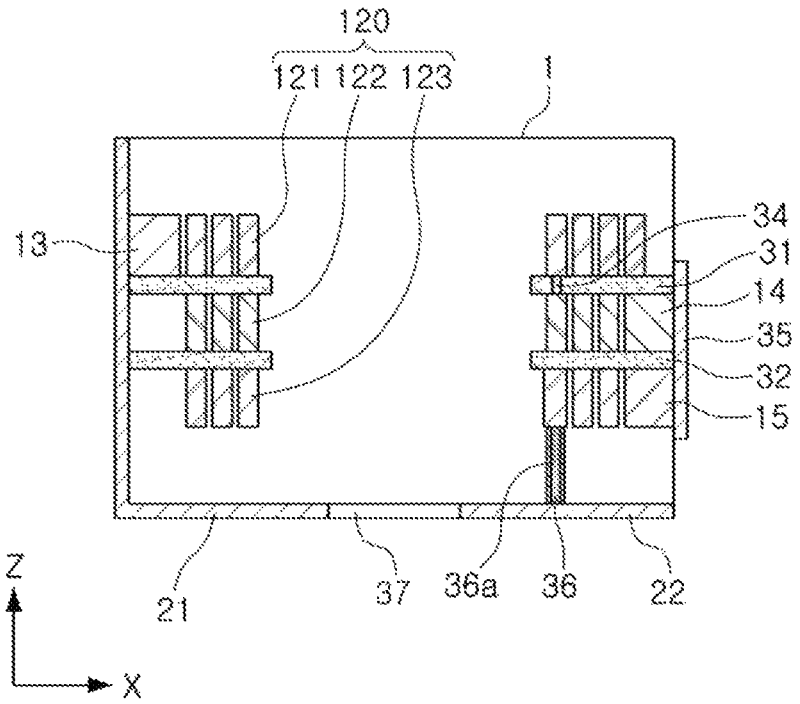
FIG. 2 is a cross-sectional view taken along an X-Z plane of a coil component according to an embodiment of the present disclosure illustrated in FIG. 1.
Figure 3:
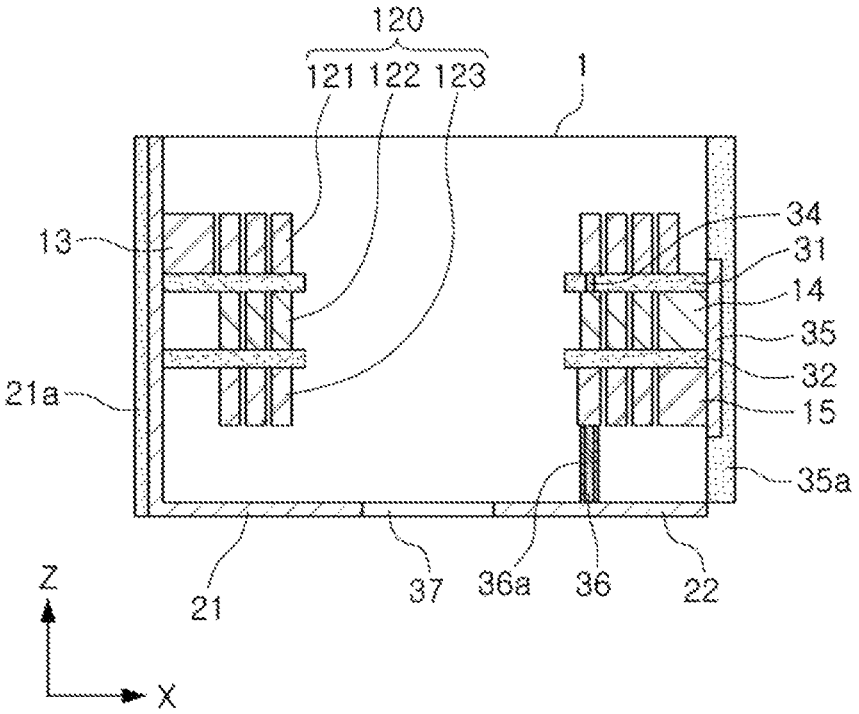
FIG. 3 is a cross-sectional view taken along an X-Z plane of a coil component according to an embodiment of the present disclosure illustrated in FIG. 1.
Figure 4A:
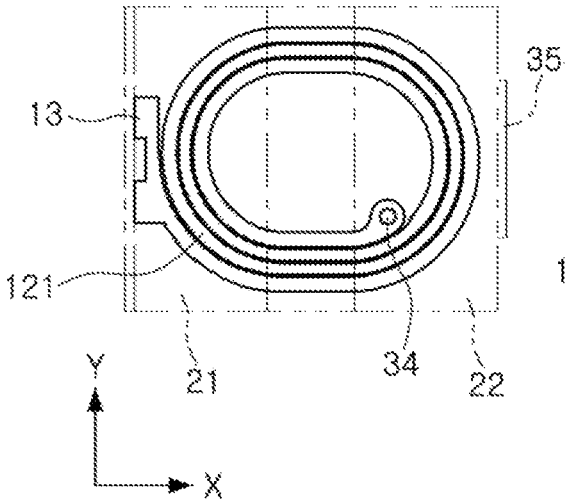
FIGS. 4A-4D are cross-sectional views taken along an X-Y plane of a coil component according to an embodiment of the present disclosure illustrated in FIG. 1.
Figure 4B:
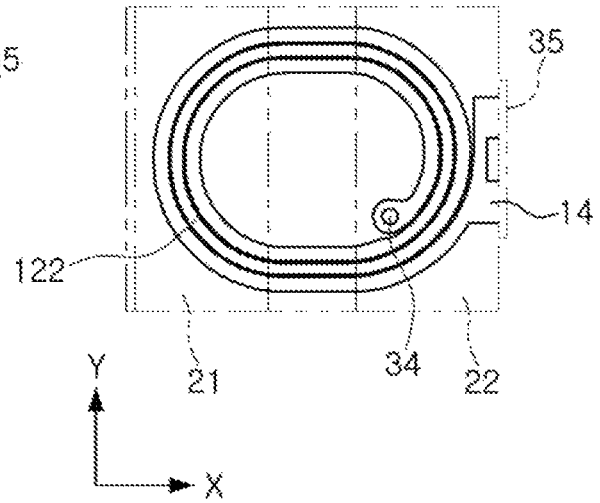
Figure 4C:
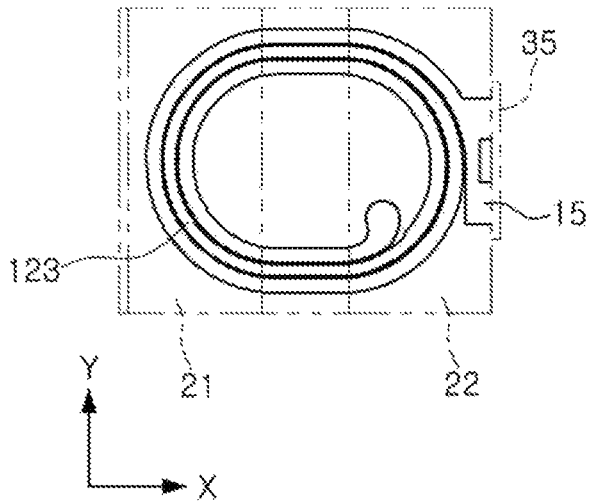
Figure 4D:
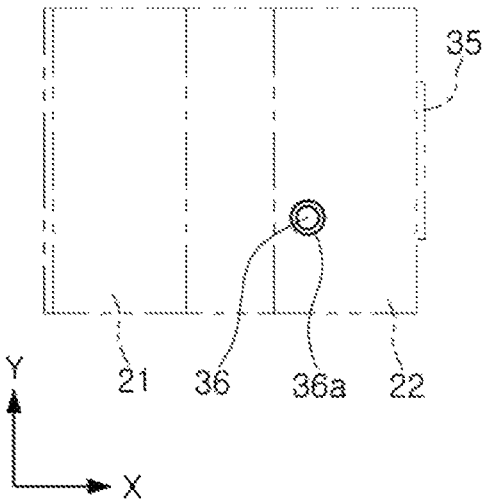

FIG. 1 is a perspective view schematically illustrating a coil component according to an embodiment of the present disclosure. FIG. 2 is a cross-sectional view taken along an X-Z plane of a coil component according to an embodiment of the present disclosure illustrated in FIG. 1. FIG. 3 is a cross-sectional view taken along an X-Z plane of a coil component according to an embodiment of the present disclosure illustrated in FIG. 1. FIGS. 4A-4D are a cross-sectional views taken along an X-Y plane of a coil component according to an embodiment of the present disclosure illustrated in FIG. 1.

Referring to FIGS. 1 to 4D, a coil component 10 according to an embodiment of the present disclosure may include a body 1, substrates 31 and 32, coil layers 121, 122, and 123, a conductive via 34, a connection electrode 35, and external electrodes 21 and 22, and may further include a post 36, an insulation film (not illustrated), an insulation layer 36*a*, an insulator 21*a*, and lead-out portions 13, 14, and 15.

The body 1 may form an exterior of a coil component according to the present embodiment, and a substrate may be disposed inside thereof.

The body 1 may be formed in a hexahedral shape as a whole.

Referring to FIG. 1, the body 1 may include a first surface 101 and a second surface 102 facing each other in a longitudinal direction X, a third surface 103 and a fourth surface 104 facing each other in a thickness direction Z, and a fifth surface 105 and a sixth surface 106 facing each other in a width direction Y. Each of the third surface 103 and the fourth surface 104 of the body 1 facing each other may connect the first surface 101 and the second surface 102 of the body 1 facing each other.

The body 1 may be formed such that a coil component 10 according to the present embodiment in which an external electrode to be described later is formed has a length of 1.2 mm, a width of 1.0 mm, and a thickness of 0.8 mm, for example, but is not limited thereto.

The body 1 may include a magnetic material and an insulating resin. Specifically, the body 1 may be formed by stacking one or more magnetic sheets including an insulating resin and a magnetic material dispersed in the insulating resin. The body 1 may have a structure other than a structure in which the magnetic material is dispersed in the insulating resin. For example, the body 1 may be made of a magnetic material such as ferrite.

The magnetic material may be a ferrite powder or a metal magnetic powder.

Examples of the ferrite powder may include at least one or more of spinel type ferrites such as Mg—Zn-based ferrite, Mn—Zn-based ferrite, Mn—Mg-based ferrite, Cu—Zn-based ferrite, Mg—Mn—Sr-based ferrite, Ni—Zn-based ferrite, and the like, hexagonal ferrites such as Ba—Zn-based ferrite, Ba—Mg-based ferrite, Ba—Ni-based ferrite, Ba—Co-based ferrite, Ba—Ni—Co-based ferrite, and the like, garnet type ferrites such as Y-based ferrite, and the like, and Li-based ferrites.

The metal magnetic powder may include at least one of iron (Fe), silicon (Si), chromium (Cr), cobalt (Co), molybdenum (Mo), aluminum (Al), niobium (Nb), copper (Cu), and nickel (Ni), and alloys thereof. For example, the metal magnetic powder may be at least one or more of a pure iron powder, a Fe—Si-based alloy powder, a Fe—Si—Al-based alloy powder, a Fe—Ni-based alloy powder, a Fe—Ni—Mo-based alloy powder, a Fe—Ni—Mo—Cu-based alloy powder, a Fe—Co-based alloy powder, a Fe—Ni—Co-based alloy powder, a Fe—Cr-based alloy powder, a Fe—Cr—Si-based alloy powder, a Fe—Si—Cu—Nb-based alloy powder, a Fe—Ni—Cr-based alloy powder, and a Fe—Cr—Al-based alloy powder.

The metal magnetic powder may be amorphous or crystalline. For example, the metal magnetic powder may be a Fe—Si—B—Cr-based amorphous alloy powder, but is not limited thereto.

The ferrite powder and the metal magnetic powder may have an average diameter of about 0.1 μm to 30 μm, respectively, but are not limited thereto.

The body 1 may include two or more types of magnetic materials dispersed in the insulating resin. In this case, the term "different types of magnetic materials" means that magnetic materials dispersed in an insulating resin are distinguished from each other by an average diameter, a composition, a crystallinity, and a shape.

The insulating resin may include an epoxy, a polyimide, a liquid crystal polymer, or the like, in a single form or in combined forms, but is not limited thereto.

The first substrate 31 may be disposed inside of the body 1, and the second substrate 32 may be disposed below the first substrate 31.

The substrates 31 and 32 may be formed of an insulating material including a thermosetting insulating resin such as an epoxy resin, a thermoplastic insulating resin such as a polyimide, or a photosensitive insulating resin, or may be formed of an insulating material in which a reinforcing material such as a glass fiber or an inorganic filler is impregnated with such an insulating resin. For example, the substrates 31 and 32 may be formed of an insulating material such as prepreg, Ajinomoto Build-up Film (ABF), FR-4, a bismaleimide triazine (BT) film, a photoimageable dielectric (PID) film, and the like, but are not limited thereto.

As the inorganic filler, one or more selected from a group consisting of silica ($SiO_2$), alumina ($Al_2O_3$), silicon carbide (SiC), barium sulfate ($BaSO_4$), talc, mud, a mica powder, aluminium hydroxide ($Al(OH)_3$), magnesium hydroxide ($Mg(OH)_2$), calcium carbonate ($CaCO_3$), magnesium carbonate ($MgCO_3$), magnesium oxide (MgO), boron nitride (BN), aluminum borate ($AlBO_3$), barium titanate ($BaTiO_3$), and calcium zirconate ($CaZrO_3$) may be used.

When the substrates 31 and 32 are formed of an insulating material including a reinforcing material, better rigidity may be provided. When the second substrate 32 is formed of an insulating material not containing glass fibers, the second substrate 32 may be advantageous for reducing a thickness of the entire coil layer.

The first and second coil layers 121 and 122 may be formed on both surfaces of the first substrate 31 facing each other, respectively, and the third coil layer 123 may be disposed on one surface of the second substrate 32, and may be disposed below the first and second coil layers 121 and 122. When a coil component 10 of an embodiment of the present disclosure is used as a power inductor, the coil layers 121, 122, and 123 may function to stabilize power of an electronic device by storing an electric field as a magnetic field and maintaining an output voltage.

Each of the coil layers 121, 122, and 123 may have a planar spiral shape forming at least one turn with reference to a core portion (not illustrated). For example, the coil layers 121, 122, and 123 may format least one turn with reference to the core portion on one surface of the substrate 31 and 32.

The first coil layer 121 may be disposed on an upper surface of the first substrate 31, and the second coil layer 122 may be disposed on a lower surface of the first substrate 31 to face the first coil layer 121. The second coil layer 122 may be disposed on an upper surface of the second substrate 32, and the third coil layer 123 may be disposed on a lower surface of the second substrate 32, located below the first substrate 31.

The first and second coil layers 121 and 122 may be formed on both surfaces of the first substrate 31, and may be electrically connected by the conductive via 34 to be described later. When the first and second coil layers 121 and 122 and the conductive via 34 are formed on one or both surfaces of the substrates 31 and 32 by a plating process, the first and second coil layers 121 and 122 and the conductive via 34 may each include a seed layer such as an electroless plating layer and an electroplating layer. In this case, the electroplating layer may have a single-layer structure or a multilayer structure. The electroplating layer of the multilayer structure may be formed by a conformal film structure in which one electroplating layer is covered by another electroplating layer, or may have a form in which another electroplating layer is stacked on only one side of the one electroplating layer. The seed layer of the first and second coil layers 121 and 122 and the seed layer of the conductive via 34 may be integrally formed without forming a boundary therebetween, but are not limited thereto.

The coil layers 121, 122, and 123 may include at least one or more conductive layers.

The coil layers 121, 122, and 123 may be formed of a conductive material such as copper (Cu), aluminum (Al), silver (Ag), tin (Sn), gold (Au), nickel (Ni), lead (Pb), titanium (Ti), or alloys thereof, but are not limited thereto.

An insulation film (not illustrated) may insulate between the magnetic material of the body 1 and the coil layers 121, 122, and 123 along surfaces of the coil layers 121, 122, and 123. The coil layers 121, 122, and 123 may include a plurality of coil patterns, and an insulation film (not illustrated) may be further disposed along surfaces of the plurality of coil patterns. An insulation film (not illustrated) may insulate between the plurality of coil patterns, and between the coil pattern and the magnetic material simultaneously.

There is no limitation on a method of forming the insulation film (not illustrated). For example, the insulation film may be formed by depositing a parylene resin or the like on the surfaces of the coil layers 121, 122, and 123 using chemical vapor deposition, or by removing an insulation resist, disposed before the plating, after the plating, and then using chemical vapor deposition. A thickness of the insulation film may be uniformly formed. The uniform thickness of the insulation film means that a width of the insulation film insulating between the coil patterns is substantially the same as a thickness of the insulation film insulating an upper surface of the coil pattern.

Since the insulation film (not illustrated) with a relatively thin thickness insulates the coil layer along the surfaces of the coil layers 121, 122, and 123, a space in which the magnetic material is filled may be relatively sufficiently secured. In particular, since the second and third coil layers 122 and 123 are electrically connected by the connection electrode 35 instead of the conductive via 34, a filling ratio of the magnetic material around the center of the core portion (not illustrated) may be increased.

The conductive via 34 may pass through the first substrate 31 to connect the first coil layer 121 and the second coil layer 122. The conductive via 34 may be disposed substantially perpendicular to the third surface 103 of the body 1. The conductive via 34 may electrically connect the first coil layer 121 and the second coil layer 122, and may be disposed on the same straight line as the post 36 to be described later, to connect the second external electrode 22 and the coil layers 121, 122, and 123. A cross-sectional shape of the conductive via 34 may be a rectangular shape as illustrated in the drawings, and may be a tapered shape narrowing in a downward direction or an inverted tapered shape narrowing in an upward direction, but is not limited thereto.

In addition, the conductive via 34 may be composed of at least one via hole and a conductive via conductor filling the via hole. A cross-sectional shape of the conductive via 34 may be determined, depending on a cross-sectional shape determined when the via hole is formed.

Generally, when the conductive via 34 is formed, since a conductive via hole passing through a substrate is formed, and the inside of the conductive via hole may be filled with the conductive material, the substrate may be disposed on the same plane as the conductive via 34. Since the post 36 described later in the coil component 10 according to the present embodiment illustrated in FIG. 2 is connected to a position corresponding to the conductive via 34, a space of the conductive via 34 occupied in the coil component 10 may be reduced. As a result, it may be advantageous to realize high inductance of the coil component.

The conductive via 34 may include at least one or more conductive layers.

The conductive via 34 may be formed of a conductive material such as copper (Cu), aluminum (Al), silver (Ag), tin (Sn), gold (Au), nickel (Ni), lead (Pb), titanium (Ti), or alloys thereof, but is not limited thereto.

The connection electrode 35 may be disposed outside of the body 1 to connect the second coil layer 122 and the third coil layer 123 to each other. The connection electrode 35 may be disposed on the side surface of the body 1 to be connected to the second and third coil layers 122 and 123. In an embodiment of the present disclosure, the connection electrode 35 may electrically connect the second coil layer 122 and the third coil layer 123, instead of the conductive via 34, to be disposed only on the second surface 102 of the body 1. As will be described later, a conductive resin layer and a Ni/Sn plating layer covering the connection electrode 35 may be further disposed on the second surface of the body 1.

The connection electrode 35 may be made of one or more selected from the group consisting of copper and nickel, but is not limited thereto.

According to an embodiment of the present disclosure, the connection electrode 35 may be disposed on the second surface 102 of the body 1, to connect the second coil layer 122 and the third coil layer 123, and may not be disposed on the coil layer 121 and the first substrate 31.

According to an embodiment of the present disclosure, a conductive resin layer (not illustrated) covering the connection electrode 35 may be further included. The conductive resin layer may include one or more selected from the group consisting of copper (Cu), nickel (Ni), and silver (Ag), and a thermosetting resin. The thermosetting resin may be a polymer resin such as an epoxy resin or a polyimide, but is not limited thereto.

According to an embodiment of the present disclosure, a first layer (not illustrated) containing nickel (Ni) and a second layer (not illustrated) containing tin (Sn) may be sequentially arranged on the conductive resin layer.

The connection electrode 35 may be formed of a conductive material such as copper (Cu), aluminum (Al), silver (Ag), tin (Sn), gold (Au), nickel (Ni), lead (Pb), titanium (Ti), or alloys thereof, but is not limited thereto.

According to an embodiment of the present disclosure, the first external electrode 21 may extend from the first surface 101 of the body 1 onto the third surface 103 of the body 1. The second external electrode 22 may be disposed only on the third surface 103 of the body 1, and may not be disposed on the second surface 102. The first and second external electrodes 21 and 22 may not be disposed on the fourth surface 104 of the body 1. Since the first and second external electrodes 21 and 22 are disposed on portions of the first surface 101 and the third surface 103 of the body 1, the influence of the external electrodes, which interfere with the flow of the magnetic flux, may be reduced, to improve the performance such as inductance (L), quality factor (Q), and the like in the minimized coil component.

According to an embodiment of the present disclosure, a conductive resin layer (not illustrated) covering the external electrodes 21 and 22 may be further included. The conductive resin layer may include one or more selected from the group consisting of copper (Cu), nickel (Ni), and silver (Ag), and a thermosetting resin. The thermosetting resin may be a polymer resin such as an epoxy resin, a polyimide, or the like, but is not limited thereto.

According to an embodiment of the present disclosure, a first layer (not illustrated) containing nickel (Ni) and a second layer (not illustrated) containing tin (Sn) may be sequentially arranged on the conductive resin layer.

The external electrodes 21 and 22 may be formed of a conductive material such as copper (Cu), aluminum (Al), silver (Ag), tin (Sn), gold (Au), nickel (Ni), lead (Pb), titanium (Ti), or alloys thereof, but are not limited thereto.

The insulators 21*a* and 35*a* may be disposed on the first external electrode 21 and the connection electrode 35, to insulate the external electrode and the connection electrode from an external impact, respectively. Specifically, the first insulator 21*a* may be disposed on the first external electrode 21 to cover the first external electrode 21, and the second insulator 35*a* may be disposed on the connection electrode 35 to cover the connection electrode 35. There is no limitation on a method of forming the insulators 21*a* and 35*a*. For example, the insulators 21*a* and 35*a* may be formed by depositing a parylene resin or the like on surfaces of the first external electrode and the connection electrode 35 using chemical vapor deposition. The insulators 21*a* and 35*a* may insulate the first external electrode 21 and the connection electrode 35 from the magnetic material, and may prevent electrical short between the other electronic components and an external electrode.

A third insulator (37 disposed on the third surface 103 of the body 1, and forming an opening (not illustrated) in a region of the third surface of the body in which the external electrodes 21 and 22 are formed, may be further included. For example, a third insulator 37 may be further disposed on the third surface 103 of the body 1, except for the region in which the external electrodes 21 and 22 are formed. There is no limitation on a method of forming the third insulator 37. For example, the third insulator 37 may be formed by depositing a parylene resin or the like on the third surface 103 and the surfaces of the external electrodes 21 and 22 using chemical vapor deposition, or the third insulator 37 may be disposed by removing an insulation resist, disposed before the plating on the external electrodes 21 and 22, after the plating, and then using chemical vapor deposition. The third insulator 37 may insulate the external electrodes 21 and 22 from the magnetic material, and may prevent electrical shorts between the other electronic components and an external electrode.

The post 36 may penetrate into the body 1 to connect the third coil layer 123 and the second external electrode 22. The second external electrode 22 may be connected to the third coil layer 123 through the post 36, in a different manner that the first external electrode 21 is directly connected to the first coil layer 121 through the first lead-out portion 13 to be described later. The post 36 may be disposed below the conductive via 34 in the thickness direction Z, and may be connected to a position corresponding to the conductive via 34. For example, the post 36 and the conductive via 34 may overlap each other in the thickness direction Z. A space occupied by the conductive via 34 in the coil component 10 may be reduced. As a result, it may be advantageous to realize high inductance of the coil component.

Since the post 36 and the conductive via 34 may be electrically connected, a diameter of the post 36 is preferably greater than a diameter of the conductive via 34.

The insulation layer 36*a* may cover a side surface of an outer wall of the post 36, and may insulate the post 36 from the magnetic material inside of the body 1. The insulation layer 36*a* may be formed by drilling to the third coil layer 123 to form a through hole (not illustrated), and to insulate the side surface of the outer wall of the post 36 by an insulating material, but is not limited thereto.

The post 36 may include at least one or more conductive layers.

The post 36 may be formed of a conductive material such as copper (Cu), aluminum (Al), silver (Ag), tin (Sn), gold (Au), nickel (Ni), lead (Pb), titanium (Ti), or alloys thereof, but is not limited thereto.

The lead-out portions 13, 14, and 15 may be connected to one end of the coil layers 121, 122, and 123, respectively, and may be exposed to the first surface 101 or the second surface 102 of the body 1. Specifically, the first lead-out portion 13 may be connected to one end of the first coil layer 121, and may be exposed to the first surface of the body 1, the second lead-out portion 14 may be connected to one end of the second coil layer 122, and may be exposed to the second surface 102 of the body 1, and the third lead-out portion 15 may be connected to one end of the third coil layer 123, and may be exposed to the second surface 102 of the body 1.

Although not specifically illustrated, each of the lead-out portions 13, 14, and 15 may be composed of a plurality of lead-out portions (not illustrated) spaced apart from each other. A space filled with the magnetic material of the body 1 may be secured by the spaced-apart lead-out portions, and coupling force between the body 1 and the coil layers 121, 122, and 123 may increase. In one embodiment of the present disclosure, widths of the respective lead-out portions 13, 14, and 15 may be differentiated, and shapes thereof may be transformed into a wavy shape, a V shape, or the like.

The first lead-out portion 13 may be plated integrally with the first coil layer 121, the second lead-out portion 14 may be plated integrally with the second coil layer 122, the third lead-out portion 15 may be plated integrally with the third coil layer 123, and at least one of the lead-out portions 13, 14, and 15 may include at least one or more conductive layers.

Each of the lead-out portions 13, 14, and 15 may be formed of a conductive material such as copper (Cu), aluminum (Al), silver (Ag), tin (Sn), gold (Au), nickel (Ni), lead (Pb), titanium (Ti), or alloys thereof, but is not limited thereto.

Hereinafter, a method of manufacturing a coil component according to an embodiment of the present disclosure will be briefly described.

Referring to FIG. 2, an embodiment of the present disclosure may include a structure that a first coil layer 121 is disposed on an upper surface of a first substrate 31, a second coil layer 122 is disposed between the first substrate 31 and a second substrate 32, and a third coil layer 123 is disposed on a lower surface of the second substrate 32.

An embodiment of the present disclosure, for example, may be realized by a method that a first coil portion having first and second coil layers 121 and 122 disposed on both surfaces of the first substrate 31, and a second coil portion having the third coil layer 123 disposed on one surface of the second substrate 32 are coupled to each other, but is not limited thereto.

An embodiment of the present disclosure, as an alternative example, may be realized by a build-up method that the second substrate 32 is coupled to the first coil portion in which the first and second coil layers 121 and 122 are disposed on both surfaces of the first substrate 31, and the third coil layer 123 is formed by a plating process, but is not limited thereto.

The substrates 31 and 32 may be formed of an insulating material including a thermosetting insulating resin such as an epoxy resin, a thermoplastic insulating resin such as a polyimide, or a photosensitive insulating resin, or may be formed of an insulating material in which a reinforcing material such as a glass fiber or an inorganic filler is impregnated with such an insulating resin. For example, the substrate 32 may be formed of an insulating material such as prepreg, Ajinomoto Build-up Film (ABF), FR-4, a bismaleimide triazine (BT) film, a photoimageable dielectric (PID) film, and the like, but is not limited thereto.

When the substrates 31 and 32 are formed of an insulating material including a reinforcing material, better rigidity may be provided. When the second substrate 32 is formed of an insulating material not containing glass fibers, the second substrate 32 may be advantageous for thinning a thickness of the entire coil layer.

The present disclosure is not limited by the above-described embodiments and the accompanying drawings, but is intended to be limited only by the appended claims. Accordingly, it should be understood that various changes, substitutions, alterations, and changes may be made by those skilled in the art without departing from the spirit and scope of the present disclosure defined in the appended claims.

The expression of "an embodiment" used in the present disclosure does not mean the same embodiment, but may be provided for emphasizing different characteristic features. However, the above-mentioned examples do not exclude that they may be implemented in combination with the features of other examples. For example, although a matter described in a particular example may be not described in another example, it can be understood as an explanation related to another example, unless otherwise stated or contradicted by that example in another example.

The terms used in the description of the present disclosure are used to simply describe an embodiment, and are not intended to limit the present disclosure. A singular term includes a plural form unless otherwise indicated.

According to the present disclosure, a coil component capable of realizing a high capacity by increasing an area in which the coil layer is formed in the same chip size even when the chip size is miniaturized, may be provided.

According to the present disclosure, a more miniaturized coil component by reducing a space occupied by a conductive via significantly, to maximize the turn number of coils, and utilizing cover space of a magnetic body, may be provided.

While example embodiments have been shown and described above, it will be apparent to those skilled in the art that modifications and variations could be made without departing from the scope of the present disclosure as defined by the appended claims.

What is claimed is:

1. A coil component comprising:

a body;

a first substrate disposed inside of the body, and a second substrate disposed below the first substrate;

a first coil layer disposed on an upper surface of the first substrate;

a second coil layer disposed between the first substrate and the second substrate;

a third coil layer disposed on a lower surface of the second substrate;

a conductive via passing through the first substrate and connecting the first coil layer and the second coil layer to each other;

a connection electrode disposed outside of the body and connecting the second coil layer and the third coil layer to each other;

a first external electrode disposed outside of the body and connected to the first coil layer; and a second external electrode disposed outside of the body and connected to the third coil layer.

2. The coil component according to claim 1, further comprising a post penetrating in the body and connecting the third coil layer and the second external electrode to each other.

3. The coil component according to claim 2, wherein the post is disposed below the conductive via.

4. The coil component according to claim 2, wherein a diameter of the post is greater than a diameter of the conductive via.

5. The coil component according to claim 2, further comprising an insulation layer insulating the post from the body.

6. The coil component according to claim 1, wherein the body comprises a first surface and a second surface opposite to each other, and a third surface and a fourth surface opposite to each other while connecting the first surface and the second surface to each other, the first external electrode has a connection portion connected to the first surface of the body, and an extension portion extending from the first surface onto the third surface of the body, and the second external electrode is disposed on the third surface of the body.

7. The coil component according to claim 6, wherein the second external electrode is not disposed on the second surface of the body.

8. The coil component according to claim 6, wherein the first and second external electrodes are not disposed on the fourth surface of the body.

9. The coil component according to claim 6, further comprising:

a first insulator covering the connection portion; and a second insulator covering the connection electrode.

10. The coil component according to claim 6, further comprising a third insulator disposed on the third surface of the body and having an opening formed in a region of the third surface of the body on which the first and second external electrodes are formed.

11. The coil component according to claim 6, further comprising:

a first lead-out portion connected to one end of the first coil layer and exposed from the first surface of the body;

a second lead-out portion connected to one end of the second coil layer and exposed from the second surface of the body; and a third lead-out portion connected to one end of the third coil layer and exposed from the second surface of the body.

12. A coil component comprising:

a body;

first to third coil layers disposed inside the body, the first coil layer having a first lead-out portion exposed from a first surface of the body, and the second and third coil layers having second and third lead-out portions respectively exposed from a second surface of the body opposing the first surface;

a conductive via disposed inside the body and connecting the first coil layer and the second coil layer to each other;

a connection electrode disposed on the second surface of the body and connecting the second and third lead-out portions to each other;

a first external electrode extending from the first surface onto a third surface of the body which connects the first and second surfaces to each other, the first external electrode connected to the first lead-out portion;

a second external electrode disposed on the third surface; and a post penetrating in the body and connecting the third coil layer and the second external electrode to each other.

13. The coil component according to claim 12, wherein the post and the conductive via overlap each other in a direction perpendicular to the third surface.

14. The coil component according to claim 12, wherein a diameter of the post is greater than a diameter of the conductive via.

15. The coil component according to claim 12, further comprising an insulation layer insulating the post from the body.

16. The coil component according to claim 12, wherein the second external electrode is disposed only on the third surface of the body, and the connection electrode is disposed only on the second surface of the body.

17. The coil component according to claim 12, further comprising:

a first insulator disposed on the first surface and covering a portion of the first external electrode on the first surface; and a second insulator disposed on the second surface and covering the connection electrode.

* * * * *